US006039231A

United States Patent [19]

White

[11] Patent Number: 6,039,231

[45] Date of Patent: Mar. 21, 2000

[54] ADJUSTABLE ENERGY CONTROL VALVE FOR A FASTENER DRIVING DEVICE

[75] Inventor: Brian M. White, Riverside, R.I.

[73] Assignee: Stanley Fastening Systems, L.P., East Greenwich, R.I.

[21] Appl. No.: 08/829,615

[22] Filed: Mar. 31, 1997

Related U.S. Application Data

[63] Continuation of application No. 08/245,585, May 18, 1994, abandoned.

[51] Int. Cl.[7] ..... B25C 1/04; B25C 5/13

[52] U.S. Cl. ..... 227/130; 227/10; 227/147; 173/169; 173/127

[58] Field of Search ..... 227/8, 10, 109, 227/110, 130, 147; 173/4, 121, 127, 132, 169, 204

[56] References Cited

U.S. PATENT DOCUMENTS

| | | | |
|---|---|---|---|
| 2,995,113 | 8/1961 | Steiner . | |
| 3,278,104 | 10/1966 | Becht et al. | 227/130 |
| 3,326,240 | 6/1967 | McConnaughay | 173/169 |
| 3,405,602 | 10/1968 | Novak . | |
| 3,527,142 | 9/1970 | Obergfell . | |
| 3,552,270 | 1/1971 | Lange . | |
| 3,603,406 | 9/1971 | Kahn | 173/108 |
| 3,795,357 | 3/1974 | Lange | 227/130 |
| 3,833,068 | 9/1974 | Hall | 173/169 |
| 3,948,051 | 4/1976 | Marshall | 60/542 |
| 3,989,113 | 11/1976 | Spring, Sr. et al. | 173/169 X |
| 4,099,659 | 7/1978 | Grimaldi, Jr. . | |
| 4,120,367 | 10/1978 | Wagner | 173/137 |
| 4,436,237 | 3/1984 | Vornberger et al. | 227/130 |
| 4,688,645 | 8/1987 | Muller | 227/130 X |
| 4,709,843 | 12/1987 | Wagenknecht et al. | 227/156 |
| 4,739,915 | 4/1988 | Cotta | 227/10 |
| 4,750,568 | 6/1988 | Roxton et al. | 173/121 |
| 4,821,941 | 4/1989 | Cotta . | |
| 5,377,769 | 1/1995 | Hasuo et al. | 173/169 |

FOREIGN PATENT DOCUMENTS

| | | | |
|---|---|---|---|
| 0129351 | 12/1984 | European Pat. Off. . | |
| 0304212 | 2/1989 | European Pat. Off. . | |
| 336021 | 10/1989 | European Pat. Off. | 227/130 |
| 0359974 A3 | 3/1990 | European Pat. Off. . | |
| 2104949 | 8/1971 | Germany . | |
| 3222949 | 6/1983 | Germany | 227/130 |

*Primary Examiner*—Rinaldi I. Rada
*Assistant Examiner*—Boyer Ashley
*Attorney, Agent, or Firm*—Pillsbury Madison & Sutro LLP

[57] ABSTRACT

A pneumatic fastener driving device includes an energy control assembly constructed and arranged with respect to a passageway leading to a piston pressure chamber to be manually movable between (1) a first position wherein the passageway is opened fully to communicate a pressure reservoir with the piston pressure chamber thereby permitting the air under pressure to communicate with the piston pressure chamber to provide maximum energy to a drive piston and (2) a second position wherein the passageway is at least partially closed restricting a flow of the air under pressure from the pressure reservoir to the piston pressure chamber thereby reducing energy to the piston while the air under pressure is maintained at a predetermined pressure value.

15 Claims, 6 Drawing Sheets

ADJUSTABLE ENERGY CONTROL VALVE FOR A FASTENER DRIVING DEVICE

This is a continuation of application No. 08/245,585, filed on May 18,1994, now abandoned.

BACKGROUND OF THE INVENTION

This invention relates to fastener driving devices, and more particularly, to portable pneumatically powered actuated fastener driving devices.

Pressure operated fastener driving devices are well-known and typically include a portable housing defining a guide track, a magazine assembly for feeding successive fasteners laterally into the guide track, a fastener driving element slidable in the drive track, a piston and cylinder unit for moving the fastener driving element through a cycle which includes a drive stroke and a return stroke, and a main valve assembly for controlling the communication of the cylinder with air under pressure communicated with the device and with the atmosphere to effect cycling, and a manually operable valve for controlling the main valve assembly through pilot pressure. These devices typically include a handle defining a pressure reservoir therein, communicating with line pressure generally at 90 to 100 psig.

In certain circumstances, for example when operating the fastener driving tool at maximum energy with respect to a workpiece such as soft wood, only a fraction of the energy is required to drive the fastener into the workpiece. Thus, the tool must absorb the excess energy which significantly reduces tool life. It can easily be appreciated by those skilled in the art that if maximum energy is used to drive the fastener into a soft workpiece, the fastener driving tool may drive the fastener too deeply into the workpiece. Thus, there exists a need to reduce the amount of excess energy absorbed by the tool and also to control the energy imparted to the fastener. When using conventional fastener driving tools, tool energy is normally regulated by changing the line pressure. For example, in certain fastener driving tools, at 100 psig line pressure, tool energy is, for example, approximately 162 in-lbs. In certain circumstances, line pressure can be reduced so as to operate the tool at a reduced energy and thus, lengthen tool life. For example, the line pressure may be reduced to 70 psig or less, which reduces tool energy to, for example, 117 in-lbs, requiring less energy to be absorbed by the tool.

In certain circumstances, tool energy can be reduced by employing a fixed orifice in an air flow path between the reservoir and the cylinder to restrict air flow from the reservoir creating a pressure drop over the piston at the cylinder. The pressure drop during tool actuation reduces the tool energy. Thus, if the above-mentioned conventional tool utilizes a fixed orifice, standard tool energy may be reduced from 162 in-lbs to approximately 117 in-lbs while maintaining 100 psig line pressure. If further reduction of tool energy is required, the line pressure may be reduced to a satisfactory level.

At a typical field location, line pressure is generally constant and set at a maximum value. Generally, there is no convenient way to regulate the line pressure, therefore, the tool energy cannot be reduced if desired to prolong the tool life. Accordingly, a need exists to regulate the tool energy of a portable pneumatic fastener driving device without adjusting the line pressure.

SUMMARY OF THE INVENTION

An object of the present invention is to fulfill the need expressed above. In accordance with the principals of the present invention, this objective is accomplished by providing pneumatic fastener driving device including a housing assembly having a main body portion defining a cylindrical drive chamber therein and a handle portion extending transversely from the main body portion for enabling a user to manually move the housing assembly in a portable fashion, the handle portion defining a pressure reservoir for containing a source of air under pressure at a predetermined pressure value, the housing assembly defining a fastener drive track; a drive piston slidably sealingly mounted in the cylindrical drive chamber for movement through repetitive cycles each of which includes a drive stroke and a return stroke; a fastener driving element operatively connected to the piston and mounted in the fastener drive track for movement therein through a drive stroke in response to the drive stroke of the piston and a return stroke in response to the return stroke of the piston; a magazine assembly carried by the housing assembly for receiving a supply of fasteners and feeding successive fasteners into the fastener drive track to be driven therefrom by the fastener driving element during the drive stroke thereof; a power control assembly carried by the housing assembly for effecting the fastener drive stroke of the fastener driving element; a piston pressure chamber communicating with an end of the drive chamber; surfaces defining a passageway within the housing assembly for communicating the pressure reservoir with the piston pressure chamber; and an energy control assembly including a valve constructed and arranged to be manually movable with respect to the passageway between (1) a first position wherein the passageway is opened fully to communicate the pressure reservoir with the piston pressure chamber thereby permitting the air under pressure to communicate with the piston pressure chamber to provide maximum energy to the piston and (2) a second position wherein the passageway is at least partially closed restricting a flow of the air under pressure from the pressure reservoir to the piston pressure chamber thereby reducing energy to the piston while the air under pressure is maintained at the predetermined pressure value.

Another object of the present invention is the provision of a device of the type described which is simple in construction, effective in operation and economical to manufacture and maintain.

These and other objects of the present invention will become more apparent during the course of the following detailed description and appended claims.

The invention may be best understood with reference to the accompanying drawings wherein an illustrative embodiment is shown.

DETAILED DESCRIPTION OF THE PRESENTLY PREFERRED EXEMPLARY EMBODIMENT

Figure 1:
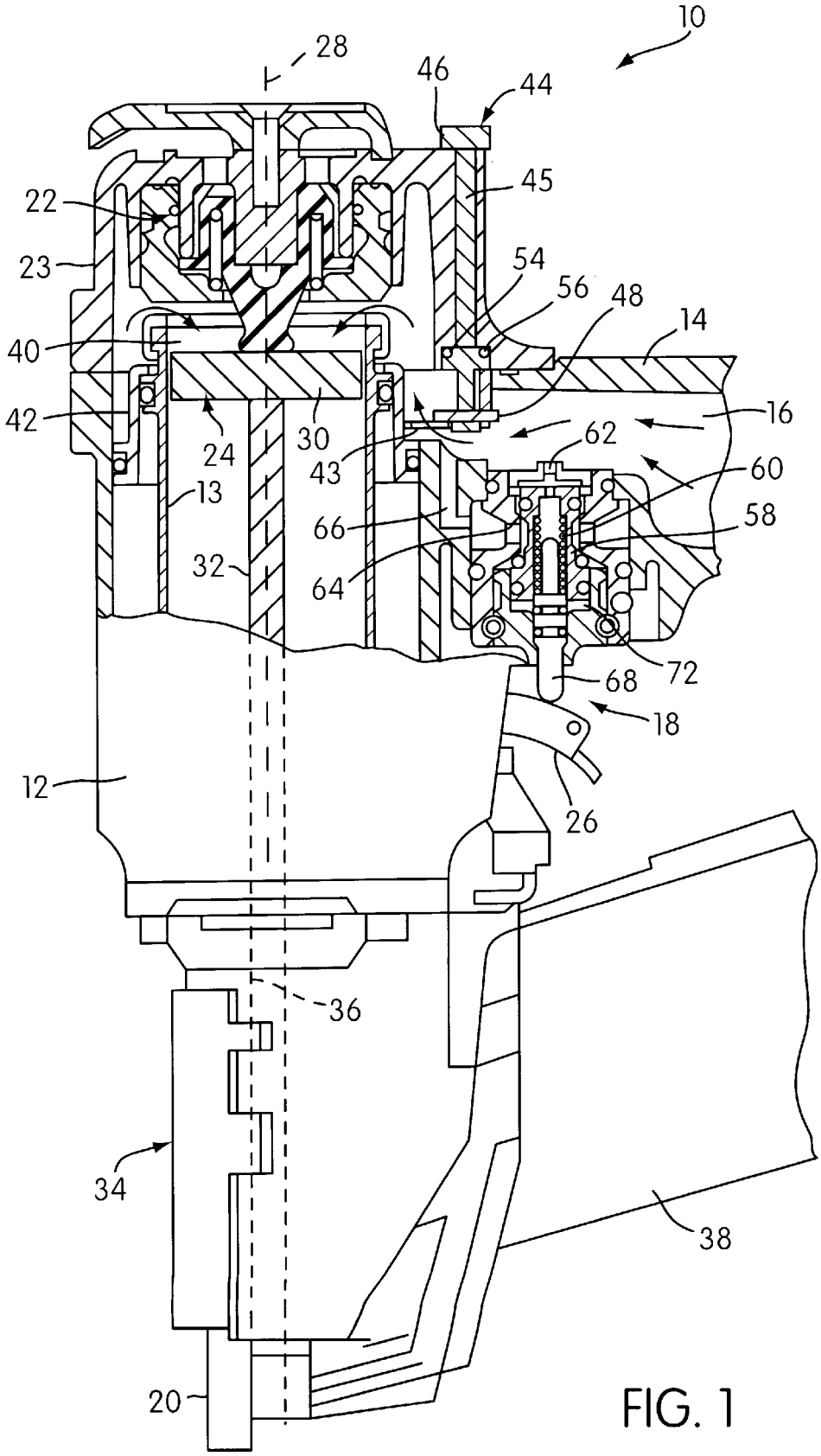
FIG. 1 is a partial sectional view of a portable fastener driving device of one embodiment of the present invention.

Referring now more particularly to FIG. 1, there is shown therein a portable pneumatically operated fastener driving device in the form of a portable tool, generally indicated at 10, which embodies the principles of the present invention. As shown, the tool 10 includes a portable housing assembly 12 having a main body portion defining a cylindrical drive chamber 13 and a hollow handle 14 extending transversely from the main body portion for enabling a user to move the device in a portable fashion. The hollow handle 14 defines a pressure reservoir 16 containing a source of air under pressure, typically between 90 and 100 psig.

A power control assembly, generally indicated at 18, is carried by the housing assembly 12 and includes a contact trip 20, for supplying the compressed air within the reservoir 16 to a pilot pressure chamber of a main valve mechanism 22 housed in cap portion 23 of the housing assembly 12. The contact trip 20 permits a trigger 26 to function when the contact trip 20 is depressed against a work surface. The main valve mechanism 22, when moved from its normally biased closed position, into an open position, communicates the source of air under pressure in reservoir 16 with a fluid pressure actuated mechanism, generally indicated at 24, which is mounted for movement within a the cylindrical drive chamber 13. The fluid pressure actuated mechanism 24 is mounted in the drive chamber 13 for movement through successive operating cycles, each including a drive stroke in one direction along a chamber axis 28 by the application of fluid pressure, and a return stroke in an opposite direction along the chamber axis 28. The fluid pressure actuated mechanism 24 includes a drive piston 30 which is slidably sealingly mounted within the cylindrical drive chamber 13 for movement through the drive and return strokes. A fastener driving element 32 is fixed at an end thereof to the drive piston 30 and extends within a nose piece assembly, generally indicated at 34 of housing assembly 12. The opposite end of the driving element 32 is adapted to engage a fastener. The driving element 32 moves with the piston 30 through successive cycles, each including a drive and a return stroke in response to the drive and return stroke of the piston 30. The nose piece assembly 34 of the housing assembly 12 defines a fastener drive track 36.

In the typical tool 10, shown, a magazine assembly 38 is carried by the housing assembly 12 for receiving a supply of fasteners and feeding successive fasteners into the drive track 36 to be driven therefrom by the fastener driving element 32 during the drive stroke thereof.

Figure 2:
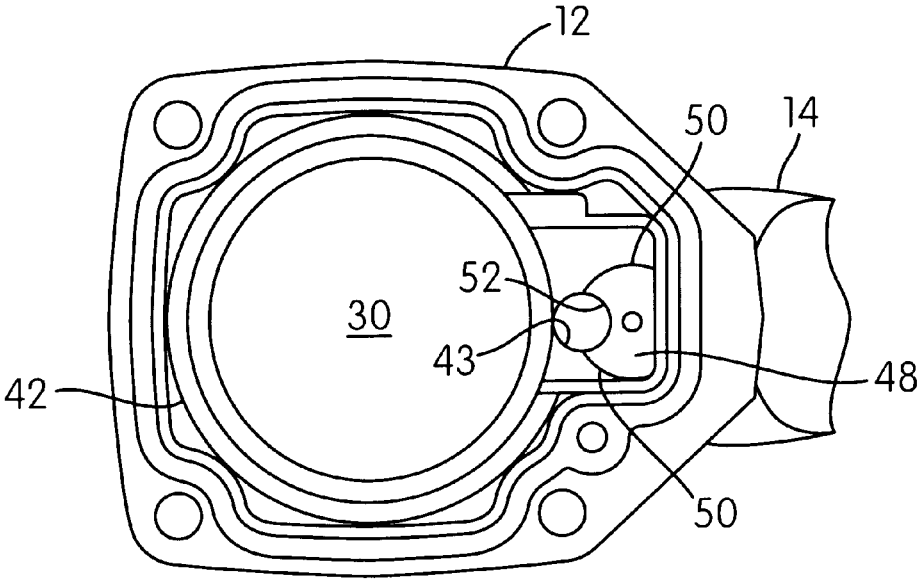
FIG. 2 is a top plan view of a portion of the fastener driving device of FIG. 1 shown with a cap portion removed for clarity of illustration and with a valve of an energy control assembly shown in a first position wherein a passageway between a piston pressure chamber and a reservoir is opened fully.

A piston pressure chamber 40 communicates with an upper open end of the cylinder or drive chamber 13. A cylindrical ring member 42 is fixedly mounted within the main body portion of the housing assembly 12 so as to surround an upper portion of the drive chamber 13. A portion of the ring member 42 extends towards the handle 14 and includes surfaces defining a fixed orifice or passageway 43 between the reservoir 16 and the piston pressure chamber 40. The cylinder ring 42 is constructed and arranged within the housing assembly 12 such that the air under pressure in reservoir 16 may pass through the passageway 43 and communicate with the piston pressure chamber 40. As best shown in FIG. 2, the passageway 43 has a diameter of approximately 0.264 inches so as to restrict a portion of the air flow from reservoir 16 to the piston chamber 40, creating a pressure drop over the piston 30 during tool actuation, thus reducing tool energy, which will become more apparent below. The cylinder ring 42 with passageway 43 creates a low plenum pressure in chamber 40 which is preferable for operating tools employing a contact trip mechanism. It can be appreciated that the cylinder ring member 42 may be constructed and arranged within the housing assembly 12 such that the air under pressure in reservoir 16 may pass only through the passageway 43 and communicate with the piston pressure chamber 40 so as to further control the tool energy.

The power control assembly 18 includes a conventional valve assembly 58 which is resiliently biased by spring 60, into a normal inoperative position as shown in FIG. 1, wherein the supply of air under pressure within reservoir 16 is enabled to pass through an inlet opening 62 and around the tubular valve assembly 58 through central openings 64 and into a passage 66 which communicates with the pilot pressure chamber for main valve mechanism 22. When the pilot pressure chamber is under pressure, the main valve mechanism 22 is in a closed position. The main valve mechanism 22 is pressure biased to move into an open position when the pressure in the pilot pressure chamber is relieved. The pilot pressure is relieved when the tubular valve assembly 58 moves from the inoperative position into an operative position. This movement is under the control of an actuator 68 which is mounted for rectilinear movement in a direction toward and away from the trigger 26. As shown in FIG. 1, the valve assembly 58 includes a lower portion defining a control chamber 72 which serves to trap air under pressure therein entering through the inlet 62 through the hollow interior of the valve assembly 58. Pressure from the supply within the reservoir 16 thus works with the bias of the spring 60 to maintain the valve assembly 58 in the inoperative position. In this position, pressure within passage 66 is prevented from escaping to atmosphere. When the actuator 68 is moved into its operative position by trigger 26, supply pressure within the control chamber 72 is dumped to atmosphere and the tubular valve 58 moves downwardly under the supply pressure. Thus, the supply pressure within the reservoir 16 is sealed from passage 66 and passage 66 is communicated to atmosphere. Pilot pressure from passage 66 is allowed to dump to atmosphere, the pressure acting on the main valve mechanism 22 moves same into its open position which communicates the air pressure supply with the piston 30 to drive the same through its drive stroke together with the fastener driving element 32. The fastener driving element 32 moves the fastener, which has been moved into the drive track 36 from the magazine assembly 38, outwardly through the drive track 36 and into the workpiece. It can be appreciated that the power control assembly 18 is illustrative only and can be of any known construction.

Figure 3:
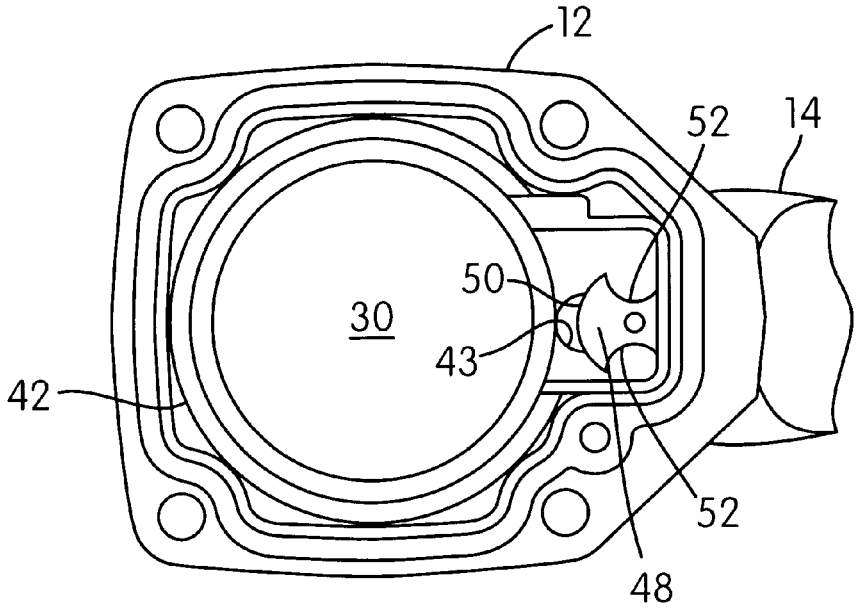
FIG. 3 is a view similar to FIG. 2 showing the valve in a second position wherein the passageway is partially restricted.

As shown in FIG. 1, the portable tool 10 includes an energy control assembly, generally indicated at 44, provided in accordance with the invention and mounted for manual rotary movement within the housing assembly 12. A proximal end of the energy control assembly 44 includes a manually engageable valve control knob 46 coupled to rod 45. The distal end of rod 45 is coupled to movable structure in the form of a valve 48 disposed adjacent the passageway 43, as will become apparent below. With reference to FIGS. 2 and 3, the valve 48 is of disk-like shape defining arcuate portions 50. Opposing recessed portions are defined by arcs 52 such that the diameter of the arcs 52 are generally equal to the diameter of the passageway 43. The valve 48 is coupled to energy control assembly 44 within housing assembly 12 such that manual rotary movement of the control knob 46 produces rotary movement of the valve 48 at the passageway 43. The rod 45 also includes a groove 54 disposed in a peripheral surface thereof to receive a suitable 0-ring seal 56 to prevent compressed air from escaping from the housing assembly 12.

In the illustrated embodiment, the fully opened passageway 43 reduces a standard tool energy from approximately 162 in-lbs to approximately 117 in-lbs at a line pressure of 100 psig. It can be appreciated that the diameter of the orifice or passageway 43 may be selected to provide a constant, reduced tool energy.

Tool energy is conventionally reduced by changing the line pressure so as to reduce the amount of energy absorbed by the tool 10, particularly when the tool 10 is used with respect to a soft-wood workpiece. For example, the 117 in-lb energy at a 100 psig line pressure can be reduced to 70 in-lbs energy at a line pressure of 60 psig. However, as noted above, there has been a need to regulate tool energy without adjusting the line pressure. In accordance with the principles of the present invention, this is achieved by restricting the passageway 43 by manually moving the energy control assembly 44 between a first position permitting maximum flow through the passageway 43 and a second position wherein flow through the passageway 43 is restricted by the valve 48. Thus, with the line pressure maintained at or near its maximum operating pressure, for example 90 to 100 psig, the tool energy can be regulated upon manual movement of the energy control assembly 44.

With reference to FIG. 2, shown with the cap portion 23 removed for clarity of illustration, the valve 48 is disposed in its first position whereby passageway 43 is opened fully so as to realize maximum tool energy. Manual rotary movement of the control knob 46 moves the valve 48 to its second or restricting position whereby a portion of the passageway 43 is restricted. When the passageway 43 is restricted, the energy is reduced accordingly. It can be appreciated that the valve 48 may be configured to provide a desired restriction of passageway 43, thereby achieving the desired tool energy. Travel stops (not shown) may be provided so as to ensure that the valve 48 is disposed properly in either its first or second positions.

In the illustrated embodiment, it can be appreciated that when the valve 48 is disposed in its first position, at 100 psig line pressure, tool energy will be approximately 117 in-lbs. However, when the valve 48 is disposed in its second position, thereby restricting a portion of the passageway 43, at 100 psig line pressure, the tool energy equals approximately 70 in-lbs.

It has thus been seen that the tool energy of the portable tool 10 can be adjusted by utilizing the energy control assembly 44 while maintaining the line pressure at or near its maximum value.

It will be understood that the components of the tool 10 other than the ring member 42 and the energy control assembly 44 are illustrative only and can be of any known equivalent construction. Further, although the movable structure is illustrated as a valve 48, it is within the contemplation of the invention to provide more than one valve to control the energy of the tool 10.

Figure 4:
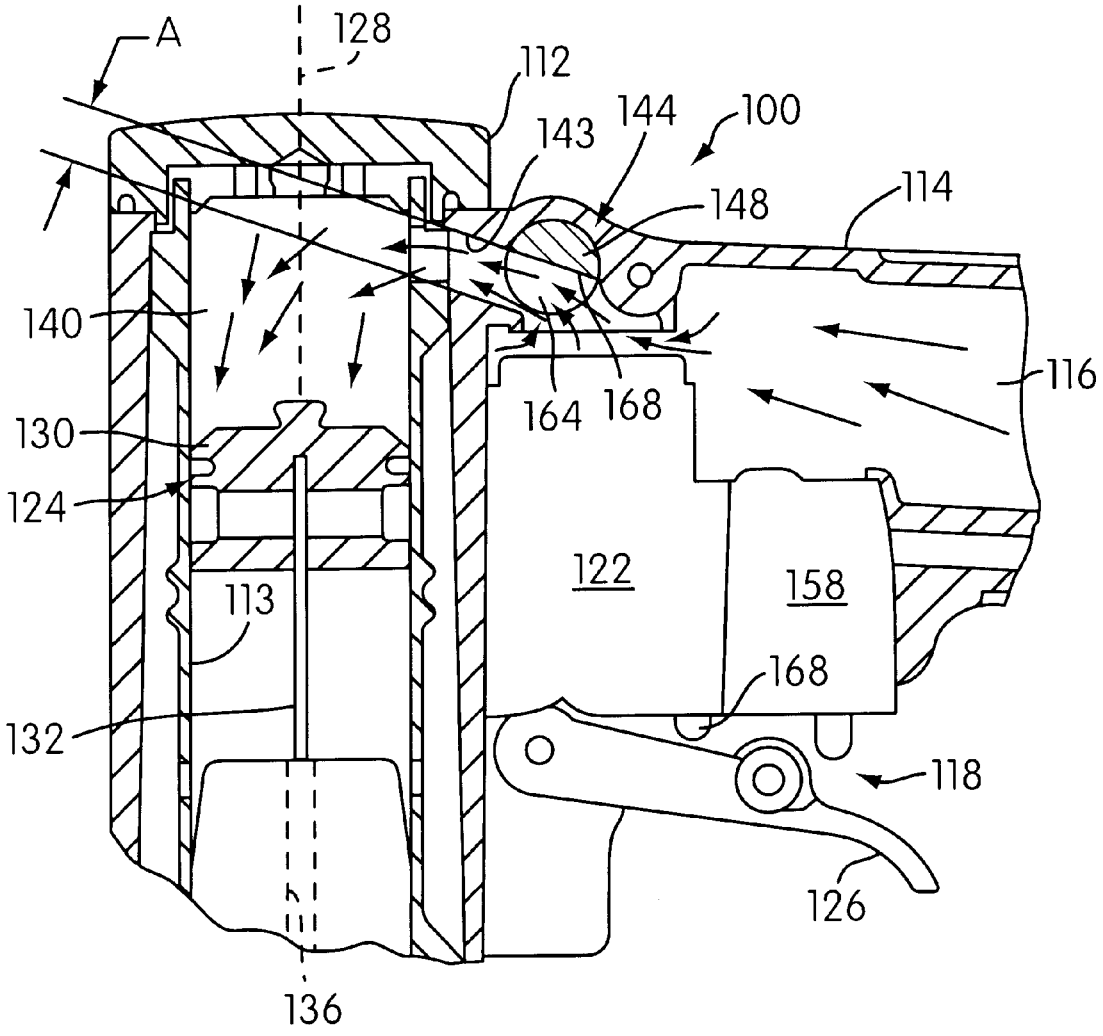
FIG. 4 is a partial sectional view of a portion of portable fastener driving device of another embodiment of the present invention shown with a valve of an energy control assembly disposed in a first position wherein a passageway between a piston pressure chamber and a reservoir is opened fully.
Figure 5:
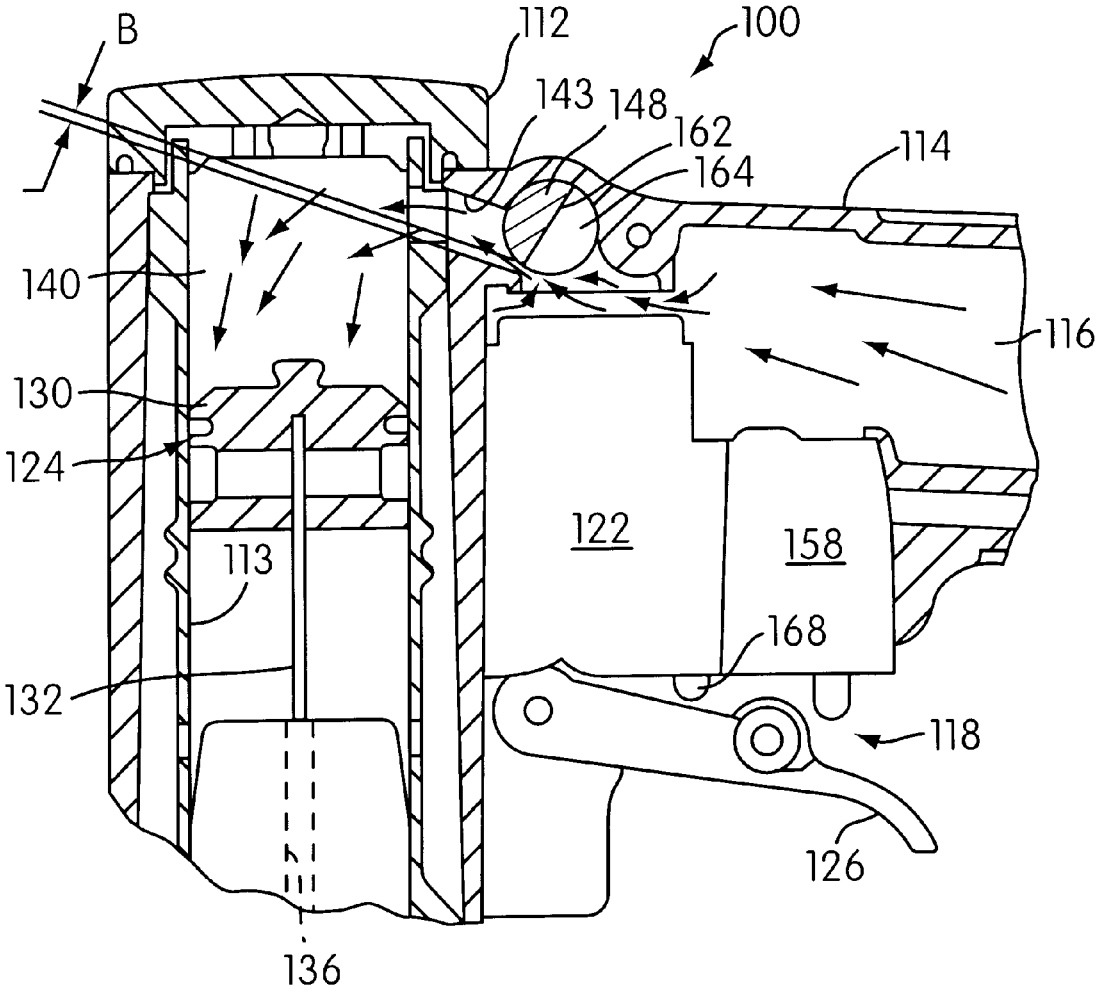
FIG. 5 is a partial sectional view of the portion of the portable fastener driving device of FIG. 4 shown with the valve disposed in a second position wherein the passageway is partially restricted.
Figure 6:
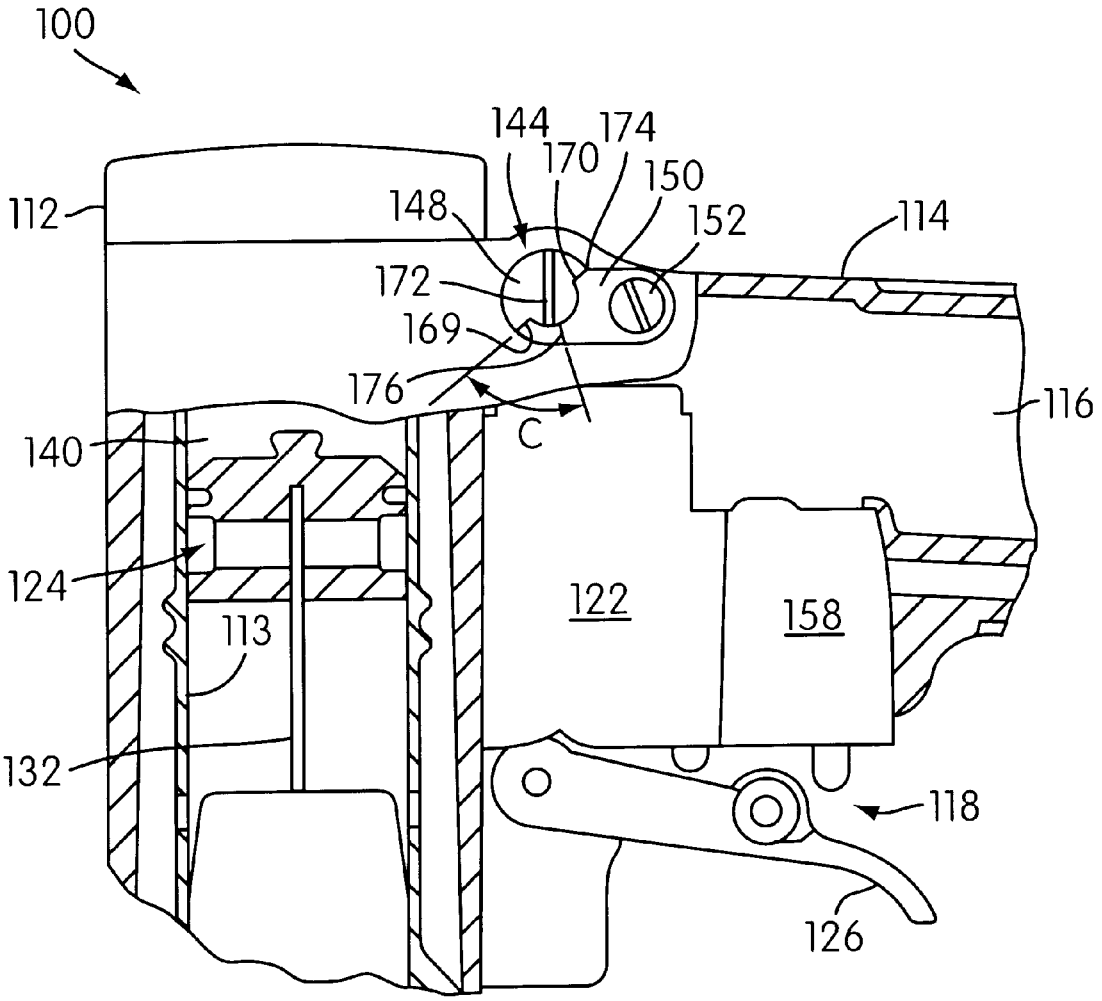
FIG. 6 is a side elevational view, partially in section, showing the energy control assembly mounted within the housing assembly of the fastener driving device.

Referring now to FIGS. 4–6, there is shown therein a portion of a portable pneumatically operated fastener driving device in the form of a portable tool, generally indicated at 100 which embodies the principles of a second embodiment of the present invention. The tool 100 is similar to the portable tool 10, however, the tool 100 is of the type which automatically repeats the working cycles which are initiated by a power control assembly, generally indicated at 118, carried by the housing assembly 112. As shown, the portable housing assembly 112 has a main body portion defining a cylindrical drive chamber 113 and a hollow handle 114 extending transversely from the main body portion. The hollow handle 114 defines a pressure reservoir 116 containing a source of air under pressure, typically between 60 and 100 psig.

As in the tool 10 of FIG. 1, the power control assembly 118, includes a contact trip (not shown), for supplying the compressed air within the reservoir 116 to a pilot pressure chamber of a main valve assembly 122, of any known construction. The contact trip permits a trigger 126 to function when the contact trip is depressed against a work surface. The main valve mechanism 122, when moved from its normally biased closed position, into an open position, communicates the source of air under pressure in reservoir 116 with a fluid pressure actuated mechanism, generally indicated at 124, which is mounted for movement within the cylindrical drive chamber 113.

As in the first embodiment, the fluid pressure actuated mechanism 124 is mounted in the drive chamber 113 for movement through successive operating cycles, each including a drive stroke in one direction along a chamber axis 128 by the application of fluid pressure, and a return stroke in an opposite direction along the chamber axis 128. The fluid pressure actuated mechanism 124 includes a drive piston 130 which is slidably sealingly mounted within the cylindrical drive chamber 113 for movement through the drive and return strokes. A fastener driving element 132 is fixed at an end thereof to the drive piston 130 and extends within a nose piece assembly (not shown). The opposite end of the driving element 132 is adapted to engage a fastener. The driving element 132 moves with the piston 130 through successive cycles, each including a drive and a return stroke in response to the drive and return stroke of the piston 130. The housing assembly 112 defines a fastener drive track 136 for the driving element 132.

As in the tool 10 of FIG. 1, the tool 100 includes a conventional magazine assembly (not shown) carried by the housing assembly 112 for receiving a supply of fasteners and feeding successive fasteners into the drive track 136 to be driven therefrom by the fastener driving element 132 during the drive stroke thereof.

With reference to FIG. 4, a piston pressure chamber 140 communicates with an upper end of the cylinder or drive chamber 113. A passageway 143 connects the piston pressure chamber 140 with the reservoir 116.

The power control assembly 118 includes a valve assembly 158 of any known construction having an actuator 168 capable of being moved by the trigger 126 to dump pilot pressure to atmosphere so that the pressure acting on the main valve mechanism 122 moves same into its open position which communicates the air pressure supply with the piston 130 to drive the same through its drive stroke together with the fastener driving element 132. The fastener driving element 132 moves the fastener, which has been moved into the drive track 136 from the magazine assembly, outwardly through the drive track 136 and into the workpiece.

Figure 7:
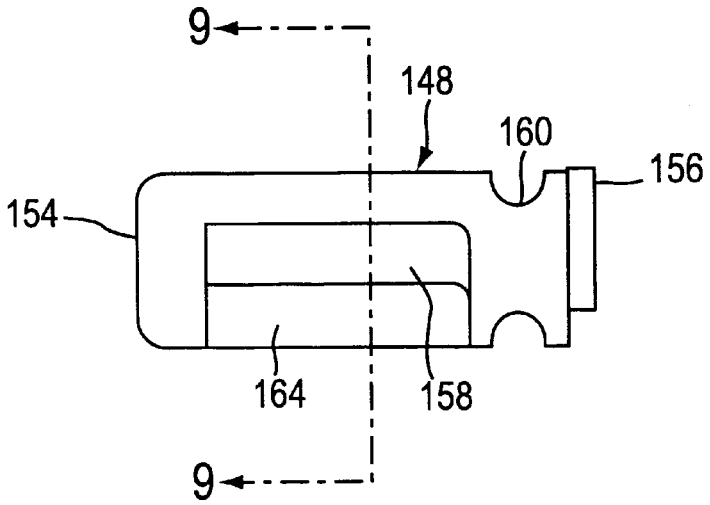
FIG. 7 is an enlarged side elevational view of the valve of the energy control assembly of FIG. 4.
Figure 8:
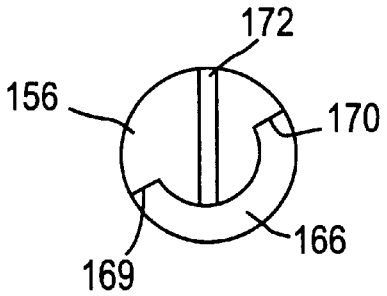
FIG. 8 is an end view of the valve of FIG. 7.
Figure 9:
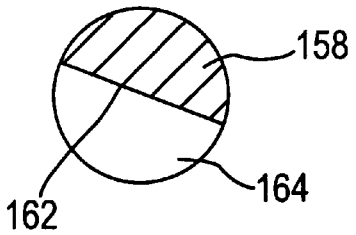
FIG. 9 is a sectional view of the valve taken along line 9—9 of FIG. 7.

As shown in FIGS. 4–6, the portable tool 100 includes an energy control assembly, generally indicated at 144. The energy control assembly 144 includes movable structure in the form of a rotary valve 148, mounted for manual rotary movement within the housing assembly 112, and a retaining member 150. The retaining member 150 is fastened to the housing assembly 112 by screw 152. As shown in FIGS. 7–9, the valve 148 is of generally cylindrical configuration including a distal end 154 and a proximal end 156, with a throat portion 158 therebetween. A groove 160 is defined in the periphery of the valve 148 near the proximal end 156 thereof for receiving a suitable o-ring seal (not shown), to seal the valve 148 within the housing assembly 112. As illustrated in FIG. 9, the throat portion 158 includes a planar surface 162, defining a boundary of channel 164, the function of which will become apparent below. As shown in FIG. 8, the proximal end 156 of the valve 148 includes a notched portion 166 defining first and second travel stops 169, 170, respectively. Tool engaging surfaces are defined in the proximal end 156 defining a slot 172 which is suitable for receiving a standard flat-head screwdriver for manually rotating the valve 148.

With reference to FIGS. 4–6, the valve 148 is mounted within the housing assembly and retained therein by the retaining member 150, fastened to the housing assembly by the screw 152. The valve 148 is constructed and arranged so that when mounted in the housing assembly 112, it extends generally transversely to the passageway 143 so that the throat portion 158 extends generally across the passageway 143. As shown in FIG. 6, the valve 148 is shown in a first position, with planar surface 162 of the throat portion 158 being generally aligned with a wall of the passageway 143. In this position, the travel stop 170 of the valve 148 engages surface 174 of the retaining member 150 (FIG. 6) preventing further movement of the valve in the clockwise direction. As illustrated in FIG. 4, when the valve 148 is in its first position, the channel 164 thereof cooperates with the passageway 143 so that the passageway 143 is opened fully, an amount shown by arrow A in FIG. 4. Thus, the air under pressure in reservoir 116 may communicate with the piston pressure chamber 140 through the unobstructed passageway 143, resulting in maximum tool energy. In the illustrated embodiment, maximum tool energy is approximately 49 in-lbs at 100 psig line pressure.

Manual engagement of surfaces defining slot 172 with a suitable screwdriver or the like and movement of the valve 148 in a counter-clockwise direction with respect to its position in FIG. 6, will rotate the valve 148 to its second, restrictive position. In the second position, the stop 169 of the valve 148 engages surface 176 of the retaining member 150 preventing further movement of the valve in the counter-clockwise direction. This manual movement of the valve 148 results in an adjustment of approximately 80 degrees, as shown by the arrow C in FIG. 6. As shown in FIG. 5, in the restrictive position, the throat portion 158 of the valve 148 is disposed in partial blocking relation with the passageway 143. Thus, the effective opening of the passageway 143 is reduced to an amount shown by arrow B in FIG. 5. In the illustrated embodiment, with the valve 148 disposed in the restrictive position, tool energy is reduced to approximately 34 in-lbs at 100 psig line pressure, which generally equals the tool energy at a line pressure of 70 psig with the passageway 143 opened fully. Clockwise movement of the valve 148 will return the valve 148 to its first position.

It has thus been seen that the tool energy of the portable tool 100 can be adjusted by utilizing the energy control assembly 144 while maintaining the line pressure at or near its maximum value.

It will be understood that the components of the tool 100 other than the energy control assembly 144 are illustrative only and they can be of any known equivalent construction. In addition, although the movable structure is illustrated as a valve 148, it is within the contemplation of the invention to provide more than one valve to control the energy of the tool 100.

Thus, the objects of this invention have been fully and effectively accomplished. It will be realized, however, that the foregoing preferred specific embodiments have been shown and described for the purpose of this invention and are subject to change without departure for such principles. Therefore, this invention includes all modifications encompassed within the spirit scope of the following claims.

What is claimed is:

1. A pneumatic driving device to be connected with a pressure line comprising:

a housing assembly including a main body portion defining a cylindrical drive chamber therein and a handle portion extending transversely from the main body portion for enabling a user to manually move the housing assembly in a portable fashion, said handle portion defining a pressure reservoir for storing a source of air under pressure at a predetermined pressure value from the pressure line, said housing assembly defining a fastener drive track;

a reciprocal drive piston slidably sealingly mounted in said cylindrical drive chamber for movement through repetitive cycles each of which includes a drive stroke, during which the drive piston is moved through an entire length of said cylindrical drive chamber by a volume of the stored source of air under pressure within said pressure reservoir, and a return stroke;

a fastener driving element operatively connected to said piston and mounted in said fastener drive track for movement therein through a fastener impacting drive stroke in response to the drive stroke of the piston and a fastener impacting return stroke in response to the return stroke of the piston;

a magazine assembly carried by said housing assembly for receiving a supply of fasteners and feeding successive fasteners into said fastener drive track to be driven therefrom by said fastener driving element during the fastener impacting drive stroke;

a power control assembly carried by said housing assembly for effecting the fastener impacting drive stroke of said fastener driving element;

a piston pressure chamber communicating with an end of said drive chamber;

a main valve disposed to seal said piston pressure chamber from said pressure reservoir and being movable during actuation of said pneumatic driving device to a position permitting said piston pressure chamber and said pressure reservoir to communicate;

surfaces defining a passageway within said housing assembly for communicating the volume of said stored source of air under pressure in said pressure reservoir with said piston pressure chamber; and a variably adjustable energy control assembly including a movable structure separate and independently controllable from said main valve, said movable structure disposed between said pressure reservoir and said piston pressure chamber and remaining fixed during said actuation of said pneumatic driving device to form a fixed restriction in said passageway through which the volume of said stored source of air under pressure travels, said movable structure being movable prior to said actuation of said pneumatic driving device to variably adjust said restriction in said passageway prior to said actuation, said movable structure being movable with respect to said passageway between (1) a maximum energy position wherein said restriction in said passageway is opened a maximum extent to communicate the volume of said stored source of air under pressure with said piston pressure chamber to provide maximum energy to said piston during the drive stroke of the piston, (2) intermediate energy positions wherein said restriction in said passageway is at least partially closed in comparison with said maximum energy position thereby restricting a flow of the volume of said stored source of air under pressure from said pressure reservoir to said piston pressure chamber so as to provide intermediate amounts of energy to said piston during the drive stroke of the piston while the air under pressure is maintained at said predetermined pressure value, and (3) a minimum energy position wherein said restriction in said passageway is opened to a minimum extent thereby minimizing the flow of the volume of said stored source of air under pressure from said pressure reservoir to said piston pressure chamber so as to provide a minimum amount of energy to said piston during the drive stroke of the piston while the air under pressure is maintained at said predetermined pressure value, said energy control assembly being selectively adjustable from said maximum position to said intermediate positions and to said minimum position in instances in which maximum energy for the fastener impacting drive stroke is not required so as to 1) adjustably reduce an amount of energy absorbed by said fastener driving device during said fastener impacting drive stroke of the fastener driving element in order to prolong the life of said fastener driving device, and 2) adjustably reduce an amount of energy imparted to said fasteners during said fastener impacting drive stroke so as to reduce a depth to which said fasteners are driven into a workpiece, without requiring a change of said pressure line.

2. The pneumatic fastener driving device according to claim 1, wherein said movable structure is a valve constructed and arranged with respect to said passageway so as to be manually rotated between said maximum and minimum energy.

3. The pneumatic fastener device as defined in claim 2, wherein said valve includes a throat portion defining a boundary of a channel defined therein, said valve being disposed within a portion of said passageway such that (1) when said valve is in said maximum energy portion, said channel aligns with the surfaces of said passageway so that said passageway is opened fully thereby permitting the air under pressure to communicate with the piston pressure chamber, and (2) when said valve is in said minimum energy portion, said throat portion at least partially closes said passageway restricting the flow of the air under pressure from said pressure reservoir to said piston pressure chamber.

4. The pneumatic fastener device as defined in claim 3, wherein said energy control assembly includes a retaining member for retaining the valve within said passageway, said valve including a proximal end having tool engaging surfaces, said proximal end including travel stop surfaces so that when said valve is engaged at the engaging surfaces with a tool and rotated in a particular direction to one of its maximum and minimum energy positions, a travel stop surface engages a surface of said retaining member to prevent further movement of said valve in the particular direction.

5. The pneumatic fastener device as defined in claim 4, wherein the travel stop surfaces are constructed and arranged with respect to said surfaces of said retaining member such that said valve rotates through an angle of at least 80 degrees between said maximum and minimum energy positions thereof.

6. The pneumatic fastener device as defined in claim 4, wherein the tool engaging surfaces define a slot for receiving a screwdriver.

7. The pneumatic fastener device as defined in claim 2, wherein the valve includes a groove in a peripheral surface thereof for accepting an o-ring seal to seal the valve within the housing assembly.

8. The pneumatic fastener device as defined in claim 2, wherein said passageway is a fixed orifice, said valve being disposed adjacent said orifice such that rotary movement of said valve from said maximum position thereof to said minimum position thereof at least partially closes said passageway.

9. The pneumatic fastener device as defined in claim 8, wherein the valve is coupled to a distal end of an elongated rod, and a proximal end of said rod includes a control knob, whereby manual rotary movement of said control knob results in rotary movement of said valve.

10. A pneumatic fastener driving device to be connected with a pressure line, comprising:

a housing assembly including a main body portion defining a cylindrical drive chamber therein and a handle portion extending transversely from the main body portion for enabling a user to manually move the housing assembly in portable fashion, said handle portion defining a pressure reservoir for storing a source of air under pressure at a predetermined pressure value from the pressure line, said housing assembly defining a fastener drive track;

a reciprocal drive piston slidably sealingly mounted in said cylindrical drive chamber for movement through repetitive cycles each of which includes a drive stroke, during which the drive piston is moved through an entire length of said cylindrical drive chamber by a volume of the stored source of air under pressure within said pressure reservoir, and a return stroke;

a fastener driving element operatively connected to said piston and mounted in said fastener drive track for movement therein through a fastener impacting drive stroke in response to the drive stroke of the piston and a fastener impacting return stroke in response to the return stroke of the piston;

a magazine assembly carried by said housing assembly for receiving a supply of fasteners and feeding successive fasteners into said fastener drive track to be driven therefrom by said fastener driving element during the fastener impacting drive stroke;

a piston pressure chamber communicating with an end of said drive chamber;

a power control assembly carried by said housing assembly including a main valve assembly movable during actuation of said pneumatics driving device from a closed position preventing communication between said pressure reservoir and said piston pressure chamber and an open position permitting communication between said pressure reservoir and said piston pressure chamber for effecting the fastener drive stroke of said fastener driving element;

surfaces defining a passageway within said housing assembly for communicating the volume of said stored source of air under pressure in said pressure reservoir with said piston pressure chamber; and a variably adjustable energy control assembly disposed within said passageway so as to be generally between said piston pressure chamber and said main valve assembly, said energy control assembly including a movable structure which is separate and independently controllable from said main valve, said movable structure being disposed between said pressure reservoir and said piston pressure chamber and remaining fixed during said actuation of said pneumatic driving device to form a fixed restriction in said passageway through which the volume of the stored source of air travels, said movable structure being movable prior to said actuation of said pneumatic driving device to variably adjust said restriction in said passageway prior to said actuation, said movable structure being movable with respect to said passageway between (1) a maximum energy position wherein said restriction in said passageway is opened a maximum extent to communicate the volume of said stored source of air under pressure with said piston pressure chamber to provide maximum energy to said piston during the drive stroke of the piston, (2) intermediate energy positions wherein the restriction in said passageway is at least partially closed in comparison with said maximum energy position thereby restricting a flow of the volume of said stored source of air under pressure from said pressure reservoir to said piston pressure chamber so as to provide intermediate amounts of energy to said piston during the drive stroke of the piston while the air under pressure is maintained at said predetermined pressure value, and (3) a minimum energy position wherein said restriction in said passageway is opened to a minimum extent thereby minimizing the flow of the volume of said stored source of air under pressure from said pressure reservoir to said piston pressure chamber so as to provide a minimum amount of energy to said piston during the drive stroke of the piston while the air under pressure is maintained at said predetermined pressure value, said energy control assembly being adjustable from said maximum position to said intermediate positions and to said minimum position in instances in which maximum energy for fastener impacting drive stroke is not required so as to 1) adjustably reduce an amount of energy absorbed by said fastener driving device during said fastener impacting drive stroke of the fastener driving element in order to prolong the life of said fastener driving device, and 2) adjustably reduce an amount of energy imparted to said fasteners during said fastener impacting drive stroke so as to control a depth to which said fasteners are driven into a workpiece, without requiring a change of said pressure line.

11. The pneumatic fastener driving device according to claim 10, wherein said movable structure is a valve constructed and arranged with respect to said passageway so as to be manually rotated between said maximum and minimum energy positions.

12. The pneumatic fastener device as defined in claim 11, wherein said valve includes a throat portion defining a boundary of a channel defined therein, said valve being disposed within a portion of said passageway such that (1) when said valve is in said maximum energy position, said channel aligns with the surfaces of said passageway so that said passageway is opened fully thereby permitting the stored source of air under pressure to communicate with the piston pressure chamber, and (2) when said valve is in said minimum energy position, said throat portion at least partially closes said passageway restricting the flow of the stored source of air under pressure from said pressure reservoir to said piston pressure chamber.

13. The pneumatic fastener device as defined in claim 12, wherein said energy control assembly includes a retaining member for retaining the valve within said passageway, said valve including a proximal end having tool engaging surfaces, said proximal end including travel stop surfaces so that when said valve is engaged at the engaging surfaces with a tool and rotated in a particular direction to one of its maximum and minimum energy positions, a travel stop surface engages a surface of said retaining member to prevent further movement of said valve in the particular direction.

14. The pneumatic fastener device as defined in claim 13, wherein the travel stop surfaces are constructed and arranged with respect to said surfaces of said retaining member such that said valve rotates through an angle of at least 80 degrees between said maximum and minimum positions thereof.

15. The pneumatic fastener device as defined in claim 13, wherein the tool engaging surfaces define a slot for receiving a screwdriver.

* * * * *